US009709326B2

(12) United States Patent
Oropeza

(10) Patent No.: US 9,709,326 B2
(45) Date of Patent: Jul. 18, 2017

(54) CANTED SPIN DRYER COMPRISING A LOCKING MECHANISM

(71) Applicant: Jesus R. Oropeza, Yuma, AZ (US)

(72) Inventor: Jesus R. Oropeza, Yuma, AZ (US)

( * ) Notice: Subject to any disclaimer, the term of this patent is extended or adjusted under 35 U.S.C. 154(b) by 638 days.

(21) Appl. No.: 13/827,878

(22) Filed: Mar. 14, 2013

(65) Prior Publication Data

US 2014/0259723 A1 Sep. 18, 2014

(51) Int. Cl.

| | |
|---|---|
| ***F26B 5/08*** | (2006.01) |
| ***F26B 11/08*** | (2006.01) |
| ***F26B 25/00*** | (2006.01) |
| ***F26B 25/12*** | (2006.01) |
| ***E05F 1/02*** | (2006.01) |

(52) U.S. Cl.

CPC ..... *F26B 5/08* (2013.01); *E05F 1/02* (2013.01); *F26B 11/08* (2013.01); *F26B 25/008* (2013.01); *F26B 25/12* (2013.01); *E05Y 2201/22* (2013.01); *E05Y 2900/608* (2013.01)

(58) Field of Classification Search

CPC ..... D06F 39/14; D06F 58/04; D06F 37/42; F26B 5/08; F26B 11/08; F26B 17/22

See application file for complete search history.

(56) References Cited

U.S. PATENT DOCUMENTS

| | | | | |
|---|---|---|---|---|
| 2,906,035 | A * | 9/1959 | De Moss | D06F 58/02 34/527 |
| 3,246,938 | A * | 4/1966 | Noren | A47L 15/0081 134/58 D |
| 3,582,173 | A * | 6/1971 | Noren | A47L 15/0081 312/228 |
| 4,810,306 | A * | 3/1989 | Noren | A47L 15/0002 134/103.1 |
| 6,099,610 | A * | 8/2000 | Palmer | A45D 44/02 137/527.8 |
| 7,028,415 | B2 * | 4/2006 | Heinzen | F26B 5/08 34/312 |
| 2004/0144138 | A1 * | 7/2004 | Takeuchi | D06F 39/14 68/24 |
| 2004/0231062 | A1 * | 11/2004 | Sharrow | D06F 37/10 8/158 |
| 2009/0140622 | A1 * | 6/2009 | Suetsugu | F24C 7/087 312/330.1 |

* cited by examiner

*Primary Examiner* — David J Laux

(74) *Attorney, Agent, or Firm* — Snell & Wilmer L.L.P.

(57) ABSTRACT

An opening and/or closing mechanism associated with a lid, door or cover of machinery are disclosed herein. According to various embodiments, the system described comprises a lid, and a lid locking mechanism. A counterbalance, a timer, and a controller may also be utilized by the system. The system may allow for automatic starting of device operation in response to s timer expiring. The system may further allow for automatic opening of the lid in response to the timer expiring without the utilization of manual assistance.

12 Claims, 6 Drawing Sheets

CANTED SPIN DRYER COMPRISING A LOCKING MECHANISM

FIELD OF INVENTION

The present disclosure generally relates to drying apparatus and their operation, in particular, the present disclosure relates a canted spin dryer having a locking mechanism.

BACKGROUND OF THE INVENTION

Industrial and commercial settings often have machinery with lids and/or coverings. Many of these machines do not comprise safety mechanisms to prevent access to moving parts. At times, these machines utilize sensors to determine if the lid is open or closed. These sensors may be used to start a machine or stop a machine. For instance, in response to the opening of the lid while the machine is working, the machine may begin to slow down and eventually stop. However, if the lid is open while moving parts are still in motion, access to moving elements may not be prevented as envisioned.

For instance, U.S. Pat. No. 7,028,415 to Heinzen et al. (herein Heinzen) discloses a canted spin dryer which uses a proximity switch to determine a position of the lid of the machine (e.g. open or closed). This Heinzen spin dryer then starts a drying cycle in response to sensing the lid has been closed. Thus, Heinzen system like other conventional dryers may be opened during the drying activity. It would be advantageous to have a system enabling the locking of the cover during fully operational states.

Also, over time, if moisture is trapped within these devices, a musty or stagnant condition may result. It is desirable to have an opening and/or closure device that is configured to minimize the likelihood of a stagnant condition occurring, such as by maintaining the system while not in operation in an open position.

Relying on mechanical moving parts to provide the force to open and close lids may also introduce failure points, leading to downtime and repair costs. Also, these mechanical moving parts to provide the force to open and close lids may require upkeep and regular maintenance. The system of Heinzen, utilizes a spring assembly that automatically lifts the lid when the lid has been manually opened beyond a selected angle between 30 and 60 degrees from a plane in which the cover lies closed. Thus, not only is the default position of the Heinzen lid closed, the system of Heinzen requires a combination of manual and mechanical intervention in order to open the lid.

The subject matter claimed herein is not limited to embodiments that solve any disadvantages or that operate only in environments such as those described above. Rather, this background is only provided to illustrate one exemplary technology area where some embodiments described herein may be practiced.

SUMMARY OF THE INVENTION

The present invention relates to an improved system and apparatus designed to address, among other things, the aforementioned deficiencies in prior art devices. In general, exemplary embodiments may relate to a canted spin dryer comprising a lid and a lid locking mechanism.

Unlike conventional devices, such as the aforementioned Heinzen device, the present canted spin dryer does not rely on a sensor, such as a proximity sensor, to determine if the lid is in a closed or open position. Similarly, the present canted spin dryer does not initiate its operation in response to a proximity sensor indication.

Moreover, and unlike conventional devices, such as the Heinzen device, the canted spin dryer described herein, does not utilize a combination of mechanical and manual intervention to open the lid. In fact, the present canted spin dryer does not utilize mechanical or manual intervention to open the lid. Moreover, the default position of the lid, when the locking mechanism is not engaged in a locked mode is in the open position. Therefore, unlike prior conventional dryers where the default position of the lid is generally in the closed position, the interior of the present canted spin dryer may air dry through evaporation. In general, a canted spin dryer including a vessel having a spinable drum, a lid coupled to the vessel configured to enclose an interior portion of the vessel, and a locking mechanism configured to restrict movement of the lid when in a locked mode, is disclosed herein. A timer duration may be initiated in response to the locking mechanism locking/engaging.

The canted dryer may be configured to begin a drying cycle in response to the timer duration expiring. The canted spin dryer may further include an overbalanced counterbalance coupled to the lid. The counterbalance may be configured to automatically move the lid from closed position to an open position in response to at least one of a timer duration expiring and/or the locking mechanism disengaging from a locked mode.

Described in further detail below, in response to a signal being received by the locking mechanism to instructing the locking mechanism to disengage and/or unlock and the lid of the canted spin dryer apparatus automatically opens without any manual or additional mechanical intervention.

BRIEF DESCRIPTION OF THE DRAWINGS

The subject matter of the present invention is particularly pointed out and distinctly claimed in the concluding portion of the specification. A more complete understanding of the present invention, however, may best be obtained by referring to the detailed description and to the claims when considered in connection with the drawing figures, wherein like numerals denote like elements and wherein:

DETAILED DESCRIPTION

Figure 1:
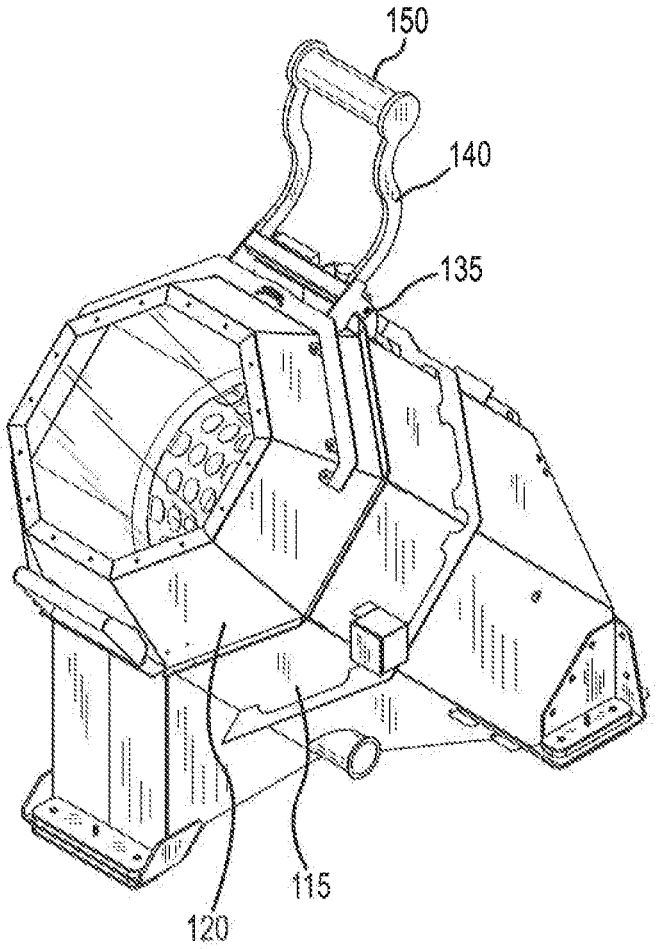
FIG. 1 is a perspective view of an exemplary embodiment of a canted spin dryer.

According to various aspects of the present disclosure, exemplary embodiments of a canted spin dryer comprising a lid 120 and a locking mechanism 200 are disclosed. Apparatus 100, an improved canted spin dryer, does not rely on a sensor, such as a proximity sensor, to determine if lid 120 is in a closed or open position. Moreover, apparatus 100 does not utilize a combination of mechanical and manual intervention to open lid 120. In fact, Apparatus 100 does not utilize mechanical or manual intervention to open lid 120 at all. The default position of lid 120, when locking mechanism 200 is not engaged in a locked mode, lid 120 is in the open position. Therefore, unlike prior conventional dryers, where the default position of the lid is generally in the closed position, in the present system, the interior of the spin dryer apparatus 100 may conveniently air dry through evaporation when not in use.

Described in further detail below, apparatus 100 comprises a locking mechanism 200 that is suitably configured to retain lid 120 in a closed position. Closing lid 120 automatically engages locking mechanism 200 in a locked mode. Thus, locking mechanism 200, when locked/engaged in a locked mode prevents movement of lid 120 in either direction. According to various embodiments, engaging locking mechanism 200 in a locked mode initiates a timer 180. Preferably, timer 180 is programmed for duration of time, and upon that time expiring, a spin cycle of the spin dryer may be initiated/begin. For instance, this initiated spin cycle of the spin dryer may be a first spin cycle of a drum from a previously generally stationary drum.

A second timer 185 may initiate in response to the duration of timer 180 expiring. In response to second timer 185 expiring, locking mechanism 200 may disengage from a locked mode and/or unlock causing lid 120 to automatically open without any manual or mechanical intervention. Mechanical intervention in this sense is referring to gear, pneumatics, spring, piston, motor, and/or the like. As these mechanical implements are not needed, the additional maintenance and/or upkeep they would demand are also negated. The automatic movement of lid 120 from a closed position to an open position may be due to gravity acting on counterbalance 150.

Lid 120 is configured to cover an opening 110 to an interior of the canted spin dryer. As stated previously, the present system does not require a sensor to determine whether lid 120 is open or closed. Stated another way, according to various embodiments, apparatus 100 does not require the use of sensors, such as magnetic sensors, optical sensors, proximity sensors or otherwise to determine if lid 120 is in a closed position.

System and apparatus 100 may utilize locking mechanism 200 to secure lid 120 in a closed, locked position. Locking mechanism 200 may secure lid 120 while the canted spin dryer is running; however, in accordance with various embodiments of the present invention, lid 120 may be opened while the spin dryer, provided such speeds are acceptable for an operator to interact with, is running. When a locked mode of locking mechanism 200 is disengaged, lid 120 may move from a position that is secured by locking mechanism 200 (locked) to an open position, such as an unlocked position.

The workings of locking mechanism 200 and/or the operation of the canted spin dryer may be controlled via a controller, such as programmable logic controller (PLC). Associated time periods and/or durations, may be controlled by timers 180, 185.

According to various embodiments and with reference to FIG. 1, apparatus 100, comprises a lid 120 coupled to a vessel 115. According to various embodiments, though lid 120 may be coupled to vessel 115 through any suitable fashion, lid 120 may be hingeably coupled to vessel 115 at a pivot location 135. Lid 120 may be used to at least partially cover a portion of vessel 115. Preferably, lid 120 may cover and/or partially cover an opening 110 of vessel 115. Vessel 115 may comprise an exterior and an interior. For instance, vessel 115 may comprise moving parts within its interior. Apparatus 100 may further comprise a counterbalance 150 coupled to lid 120 configured to move lid 120 from a second position to a first position, such as a locked position to an unlocked position.

Counterbalance 150, may be any type of counterbalance. For instance, counterbalance 150 may comprise a weighted element configured to utilize the force of gravity acting on counterbalance 150 to automatically move lid 120 from a closed position to an open position. Specifically, counterbalance 150 may automatically move lid 120 from a closed position to an open position without manual intervention. Stated another way, as counterbalance 150 moves towards the ground, lid 120 and/or lever arm 140 pivots on pivot location 135 and moves in a direction away from opening 110. Thus, counterbalance 150 is not configured to counterbalance the weight of lid 120 with an equivalent balanced load. Thus, counterbalance 150 may be configured to be overbalanced with respect to lid 120. Counterbalance 150 may be any suitable shape. Counterbalance 150 may be coupled to lid 120 via any suitable coupling. For instance, counterbalance 150 may be integral to lid 120 and/or counterbalance 150 may be coupled to lid 120 through a lever arm 140.

The length and/or shape of lever arm 140 may be determined based on the weight of counterbalance 150 and/or the size and weight of lid 120. The placement of counterbalance 150 along lever arm 140 may be determined upon the weight of lid 120. The size of counterbalance 150 and the weight of counterbalance 150 may be selected such that it produces smooth and controlled opening of lid 120 without the need for additional manual or mechanical manipulation.

According to various embodiments, a retaining member, such as a portion of a locking mechanism 200 (e.g. pin 210), may restrict movement of lid 120. This retaining member, and/or locking mechanism may be any retaining member such as a latch, detent, cam, pin, hook, grip, and/or the like. Stated another way, in response to pin 210 being disengaged in an unlocked mode, gravity acting on counterbalance 150 pivots lid 120 via pivot location 135 to an open position. Locking mechanism 200 may be configured to automatically engage and/or disengage according to a desired time period associate with an operational mode of the canted spin dryer.

According to various embodiments, the operation of locking mechanism 200 may be overridden as desired. For instance, an operator may actively toggle an emergency open switch and/or button to disengage locking mechanism 200 prior to its preprogrammed release/retraction time. Toggling this emergency open switch may also result in initiating the stopping of the moving parts, e.g. the drum, within the interior of vessel 115.

An alarm and/or indicator may initiate prior to and/or in concert with lid 120 opening. For instance, a light may illuminate shortly prior to lid 120 opening. A tone may indicate lid 120 is about to open and/or opening. These tones may be distinct depending on the nature of the event. According to various embodiments, due to the noisy environment machines generally operate within, a haptic response may initiate prior to and/or in concert with lid 120 opening. According to various embodiments, apparatus 100 may be used with and/or retrofit to existing machines. For instance, according to various embodiments, and with continued reference to FIG. 1, the canted dryer may be configured to spin its contents to remove surface liquid on the contents. The contents may be any contents having surface liquids to be removed; however, according to various embodiments, the contents of canted dryer may comprise produce, such as leafy vegetables.

This spin dryer may comprise a rotatable drum ergonomically canted at an angle between about 60 and about 30 degrees from vertical. Preferably, the spin dryer may comprise a drum canted at an angle of 45 degrees from vertical. This canted drum may assist with loading and unloading contents into and from the canted dryer. Also, the angle of the canted drum may assist with leveling the load (contents) within the drum. For instance, a basket or container, such as a perforated container, filled with contents may be loaded into the drum.

Figure 2A:
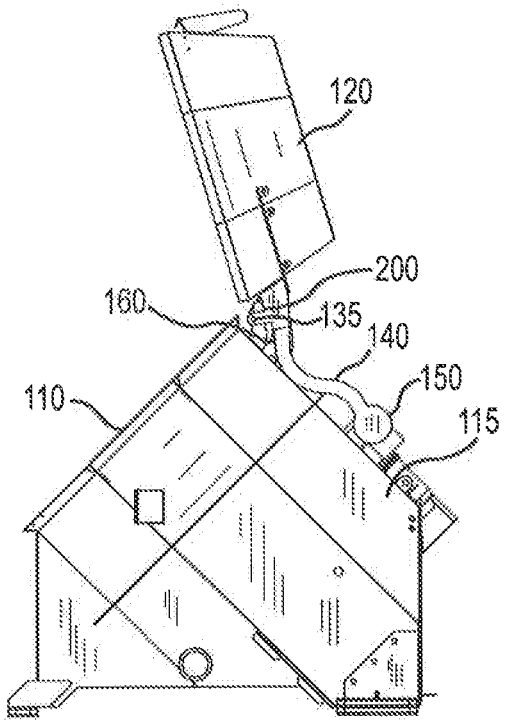
FIGS. 2A and 2B depict an exemplary apparatus in an open and closed positions.
Figure 2B:
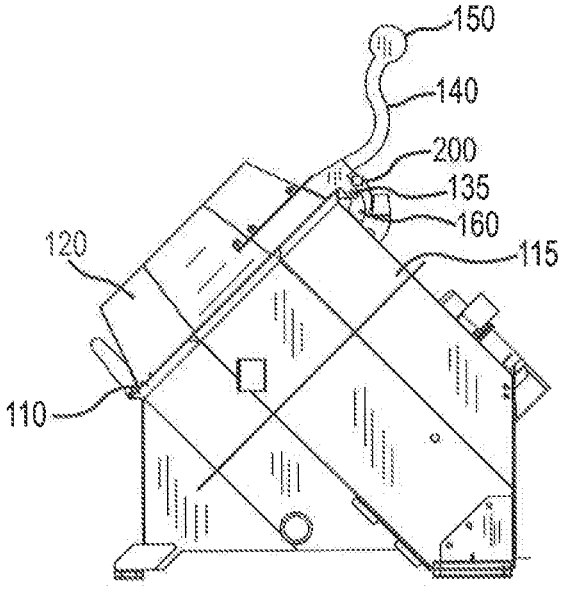

The opening 110 of canter dryer for accessing the interior of vessel 115 may be along a plane oriented approximately orthogonal to the angled axis of the drum of the canted dryer. The plane of the this angled opening 110, as depicted in FIGS. 2A and 2B, may be approximately 45 degrees. Opening 110 may be covered by lid 120 (see FIG. 2B).

In addition to coupling counterbalance 150 to lid 120, in response to lid 120 being in an open position, lever arm 140, may serve as a forward stop limiting the motion of lid 120. For instance, lever arm 140 may make contact with an exterior side surface of vessel 115 and limit further motion of lid 120. Thus, lever arm 140 may limit motion of lid 120 from exceeding an extreme open position.

At the interference location between lever arm 140 and the side surface of vessel 115, a cushioning and/or protecting shield may be applied to decrease wear on the devices. In addition to and/or in lieu of the protecting shield being applied to the side surface of vessel 115, a protecting shield may be applied to a portion of lever arm 140. For instance, a stopper or cushioning shield may be applied to a portion of lever arm 140 to decrease wear on lever arm 140 and/or the side surface of vessel 115.

Though lid 120 may be coupled to vessel 115 through any suitable coupling mechanism, lid 120 may be coupled to vessel 115 substantially at pivot location 135 via hinges and/or brackets 160, 165. One portion of bracket 160 may be coupled to vessel 115 while another portion of bracket 165 may be coupled to lid 120. According to various embodiments, collocated on bracket 165 is aperture 215. Aperture 215 may be a recess, slot and/or hole configured to receive a portion of locking mechanism 200, such as pin 210.

Figure 3:
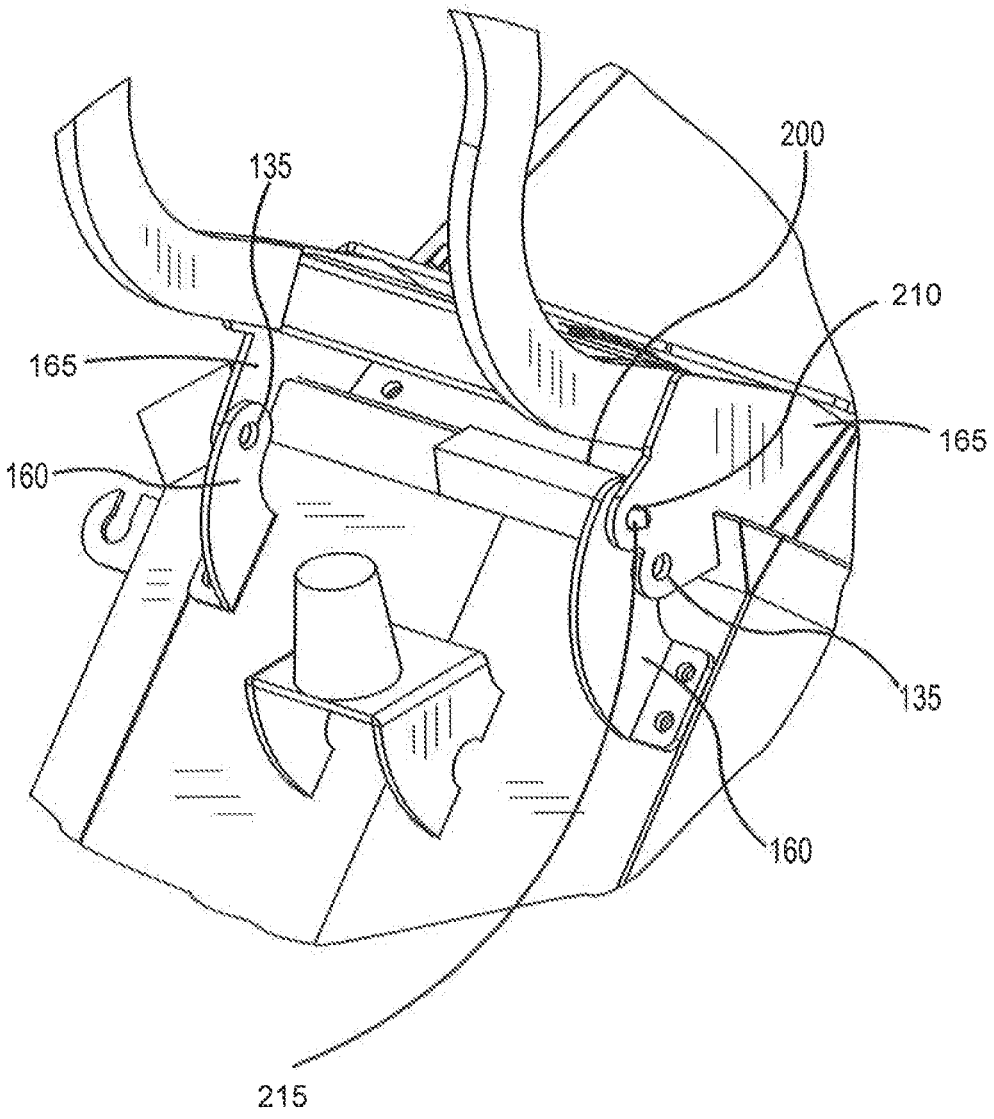
FIG. 3 is a close-up of apparatus as viewed externally from the rear when the cover is closed.

Turning to FIG. 3, which depicts a close-up view an exemplary embodiment of bracket 160, 165 and their locations, it should be appreciated aperture 215 of bracket 165 moves in concert with lid 120. For instance, as lid 120 moves from an open position towards opening 110, aperture 215 moves towards pin 210 of locking mechanism 200. For instance, aperture 215 may moves towards pin 210 in a generally arcing motion. Thus, during opening of lid 120, pin 210 advantageously pushes against a side surface of bracket 165 until aperture 215 is linear alignment with pin 210.

According to various embodiments, pin 210 may be under constant force in the direction of the opening of aperture 215. Thus, pin 210 may be biased in an extended position. As aperture 215 moves in-line with pin 210, pin 210 may move into aperture 215 and restrict further movement of lid 120 in any direction (e.g. locked mode). Thus, according to various embodiments, pin 210 within aperture 215 may define a locked mode. The movement of pin 210 into aperture 215 may be automatic, due to the biasing of pin 210. The placement of aperture 215 may be determined based on a desired location of lid 120 that is between at least partially open and making contact with opening 110, that is closed.

An operator may move lid 120 from an open position to a position which engages locking mechanism 200, such as to a position in which pin 210 engages aperture 215. The operator may overcome the force of gravity acting on counterbalance 150 while moving lid 120 from an open position to a position which engages locking mechanism 200. In response to pin 210 engaging aperture 215, locking mechanism 200 restricts movement of lid 120 and/or overcomes the force of gravity acting on counterbalance 150. According to various embodiments, an automated closing device, such as a piston, gear, or spring may be used in addition to counterbalance 150; however, no automated opening or closing device, such as a piston, gear, or spring is required.

In response to pin 210 engaging aperture 215, timer 180 may be initiated. Timer 180 may be set to any desired time period, such as a few seconds. In response to timer 180 expiring, the drum of canted dryer may be instructed, via a controller, such as programmable logic controller (PLC) to initiate spinning. Stated another way, engaging the locking mechanism 200 preferably begins a timer 180. When the duration of timer 180 expires the spin dryer begins operation. Apparatus 100 may have a default spin run-time.

According to various embodiments, in addition to timer 180 expiring, spinning may be initiated through an operator toggling a start control, such as start button. According to various embodiments, in addition to timer 180 expiring, spinning may be initiated through an operator entering a programmed recipe for each product type. For instance, the canted dryer may spin for any desired length of time according to any preprogrammed recipe of drying cycle. For example, it may be desirable for certain products to be spun dry at a lower revolution per minute to reduce mechanical breakdown of the product and/or for a shorter period of time as compared with other products. Thus, in response to both timer 180 expiring and a recipe being selected based on a product type and/or a start control being toggled, spinning may be initiated. In the alternative, in response to both timer 180 expiring and a run-time/speed being entered and/or a start control being toggled, spinning may be initiated.

As noted above, spinning may last any desired duration. A run-time timer 185 may be associated with each desired duration of spinning and/or each recipe. This run-time duration may be when the canted dryer drum stops spinning or may be prior to the canted dryer drum stopping spinning. Run-time timer 185 may be initiated in response to timer 180 expiring. Preferably, the duration of run-time timer 185 expiration is associated with a revolution per minute that is acceptable for an operator to interact with the drum. In response to the run-time timer 185 duration expiring, pin 210 may be temporarily automatically retracted from aperture 215. For instance, in response to a signal being sent to a solenoid, such as electromechanical solenoid 220, pin 210 may automatically retract. According to various embodiments, in response to the drum reaching a desired revolution per minute value, pin 210 may be sent a signal to automatically retract from aperture 215. This revolution per minute may be when the canted dryer drum stops spinning or may be prior to the canted dryer drum stopping spinning. Preferably, the desired revolution per minute value selected is one that is acceptable for an operator to interact with the drum. In response to pin 210 retracting, lid 120 automatically moves, without manual intervention, from a second position to a first position. Run-timer 185 and timer 180 may be the same or different timers.

Figure 4A:
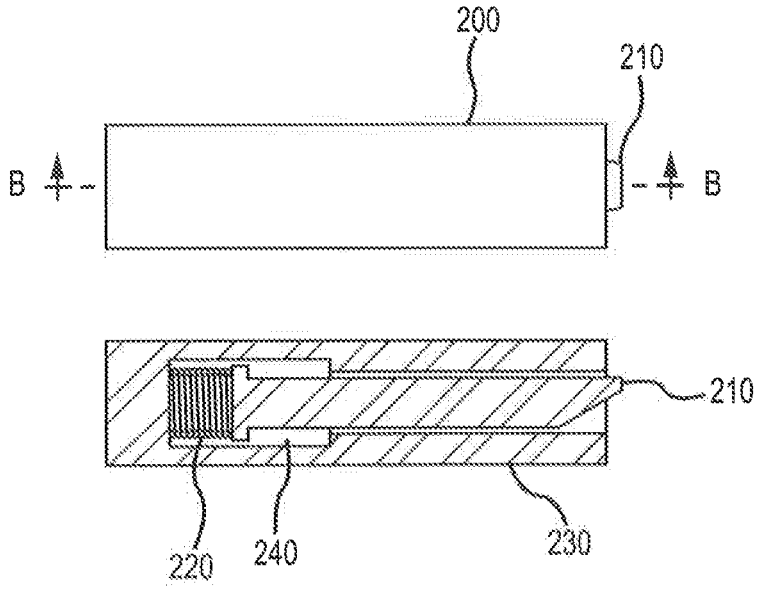
FIG. 4A depicts a side view of an exemplary locking mechanism and a cutaway view of the locking mechanism along plane B-B.
Figure 4B:
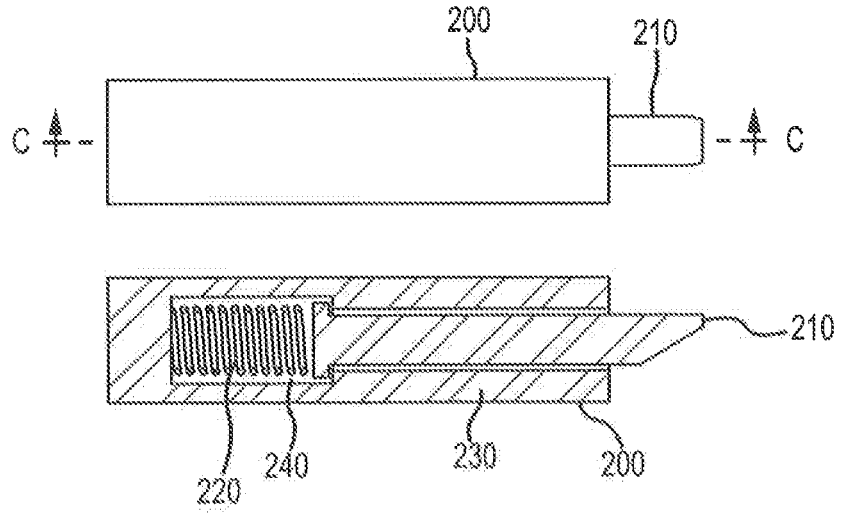
FIG. 4B depicts a side view of an exemplary locking mechanism and a cutaway view of the locking mechanism along plane C-C.

With reference to FIGS. 4A and 4B, an exemplary locking mechanism 200 is depicted. FIG. 4A depicts electromechanical solenoid 220 configured to pull pin 210 in a withdrawn position within cavity 240 defined by locking mechanism 200 housing 230. FIG. 4B depicts electromechanical solenoid 220 applying a linear force on pin 210 and/or allowing the biasing of locking mechanism 200 to push pin 210 in an extended position, such as when pin 210 is interfacing with aperture 215. Thus, a closed position may be defined by the position of lid 120 when the locking mechanism 200 is locked and an open position of lid 120 is defined by the position of lid 120 when locking mechanism 200 is unlocked. While generally desirable for lid 120 is closed, according to various embodiments, lid 120 may not be completely closed with locking mechanism 200 locked.

Figure 5:
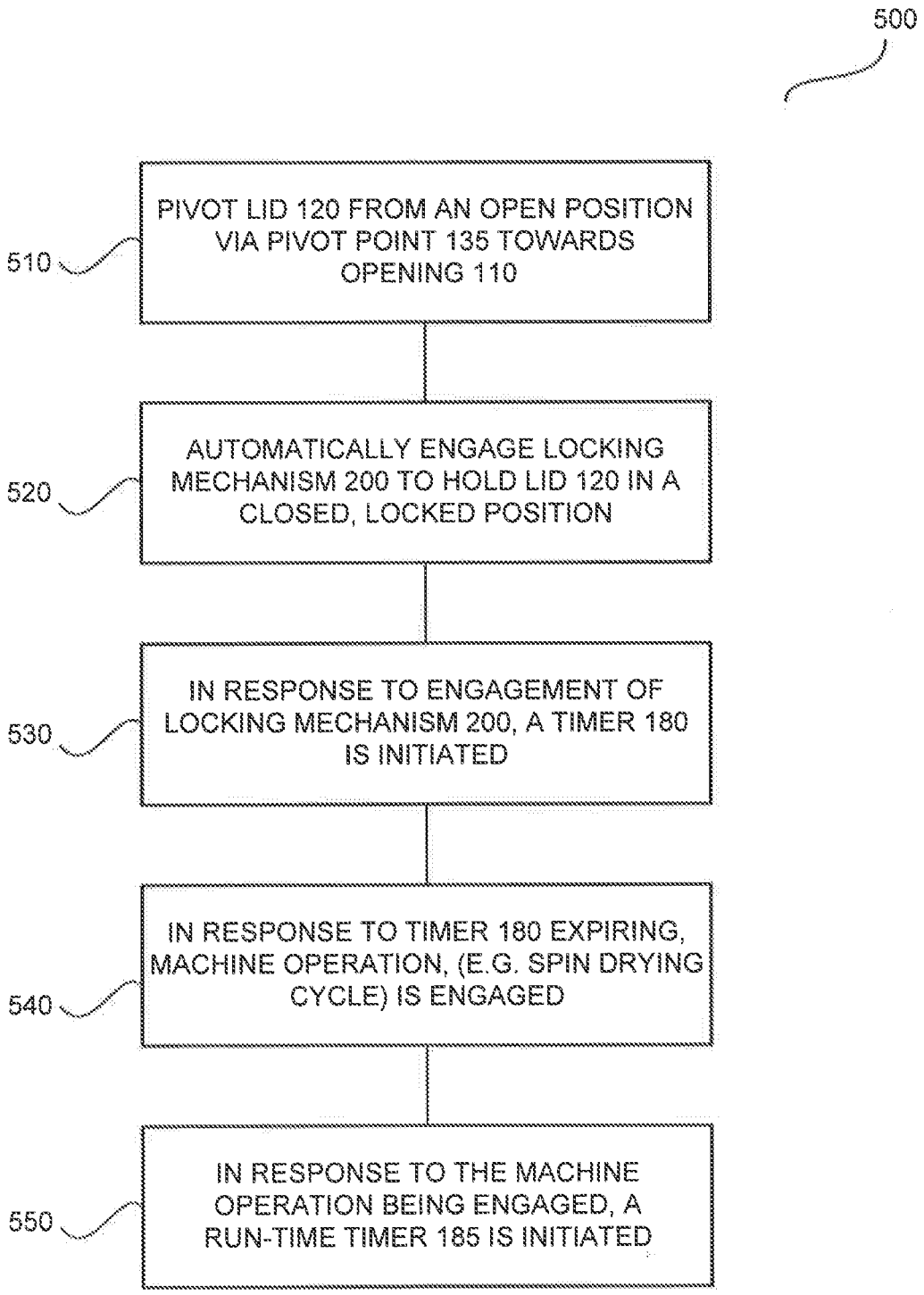
FIG. 5 depicts a process for closing an exemplary canted spin dryer according to an embodiment; and, FIG. 6 depicts a process for opening an exemplary canted spin dryer according to an embodiment.
Figure 6:
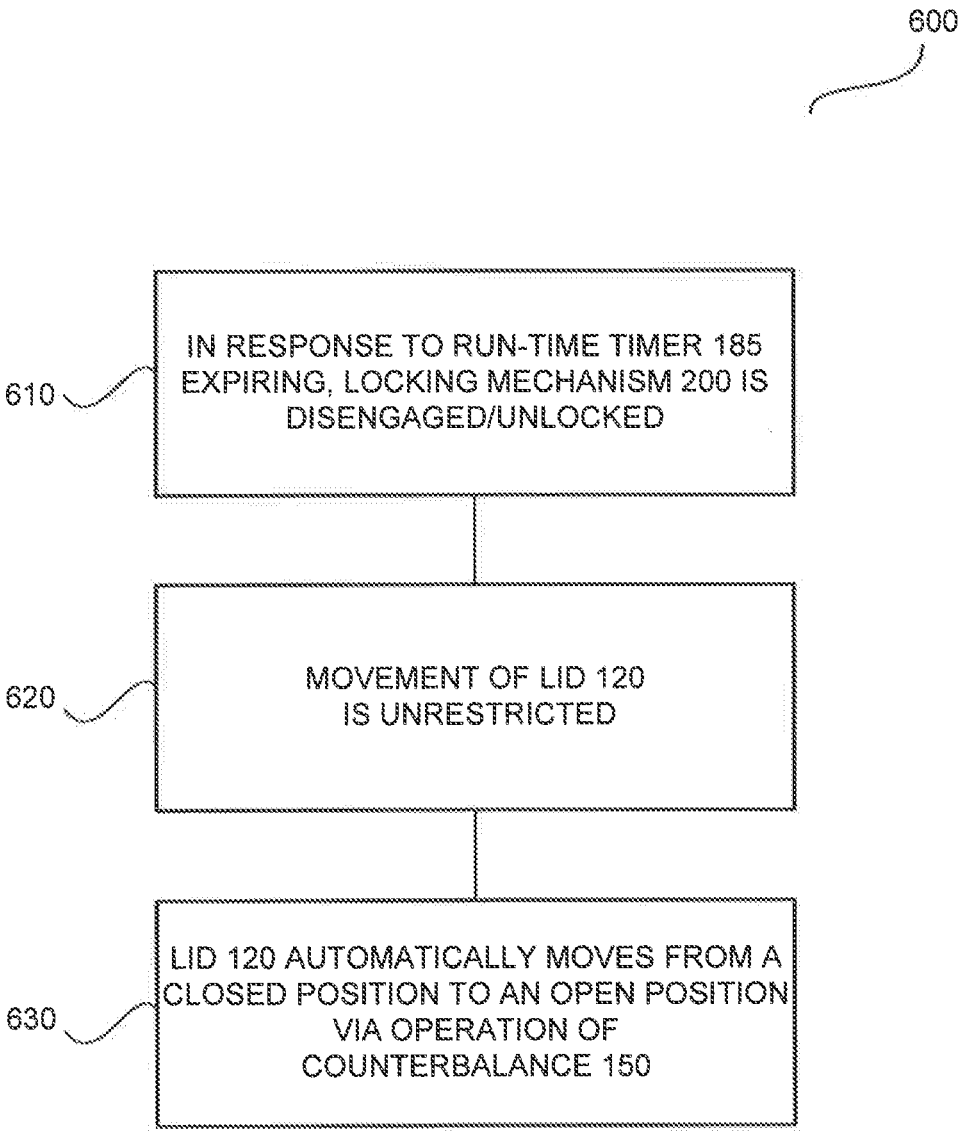

An operational process, with reference to FIGS. 5 and 6 and process flows 500 and 600, is described as follows. A machine having moving parts, such as a spin dryer, may be loaded with contents. Lid 120 may be moved from an open position towards an opening housing the moving parts (step 510). This movement may a manual movement, such as an operator manually hingeably pulling lid 120 down towards opening 110 via pivot point 135. The movement may be continued until locking mechanism 200 is engaged in a locked mode. (step 520) The locked mode of locking mechanism 200 may be manually engaged or automatically engaged, such as a locking mechanism 200 biased in the extended position, set to force pin 210 into aperture 215 when pin 210 and aperture 215 are aligned. In response to locking mechanism 200 being engaged in the locked mode, lid 120 travel is restricted/stopped. Thus, an operator may not continue to move the lid in either direction up or down° In response to locking mechanism 200 being engaged in the locked mode, timer 180 is initiated (step 530). This may be a selectable period of seconds, such as about 0.03 seconds to 0.06 seconds, about 0.3-1.5 seconds, or about 1.5-3 seconds. According to various embodiments, timer 180 is initiated and counts down or up for about 0.05 seconds. In response to the selected timer 180 duration expiring, a spin drying cycle is engaged. (step 540) For instance, PLC coupled to the control panel may initiate the spin cycle of a the canted spin dryer in response to timer 180 duration timing out.

In response to the machine operation completing its task according to its operational design, PLC may be programmed to wait a selected duration of time and disengage locking mechanism 200 from the locked mode. Alternatively, in response to timer 180 duration timing out and/or machine operation being engaged a second run-timer 185 duration may be initiated. (Step 550).

In response to the selected second run-time tinier 185 duration expiring, the locking mechanism 200 is disengaged from the locked mode. (Step 610). For instance, pin 210 may be removed from aperture 215, such as via solenoid 220. Thus, counterbalance 150 is allowed to operate. (Step 620). In response to locking mechanism 200 being disengaged from the locked mode, lid 120 may be moved from a closed and locked position to an open and/or unlocked position. (step 630) Thus, in response to pin 210 retracting/being withdrawn, the travel path of the lid bracket 165 that rotates in concert with lid 120 is no longer restricted. Counterbalance 150 causes lid 120 to open without use or need of manually starting the motion. Lid 120 opens as a "hands free" operation.

Pin 210, may be held in this withdrawn/retracted position for a set duration to allow lid bracket 165 move from a position that is in-line with pin 210. In response to this set duration expiring, solenoid 220 may discontinue its pull on pin 210 and due to the biasing of locking mechanism 200 and/or pin 210, pin 210 is ready to automatically engage aperture 215 in response to aperture 215 moving in-line with pin 210.

According to various embodiments, as the present device is not reliant upon sensors for operation, the canted dryer does not start in response to sensing a lid closing. Sensing equipment may be costly and a point of failure. Removing the need for these sensors may make the end product more robust and less likely to have a false positive.

The natural default position of lid 120 may be in the open position. In this way, when the moving parts of the machine that lid 120 is covering are not moving, lid 120 is generally open. Thus, in the case of a dryer, such as a canted dryer, the interior of vessel 115 is able to "breath" and moisture may evaporate rather than becoming trapped within vessel 115.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. For instance, aspects of the systems described herein may be applicable to devices for polishing, washing, drying, finishing, separating, and the like. Furthermore, those skilled in the art having read this disclosure will recognize that changes and modifications may be made to the exemplary embodiments without departing from the scope of the present invention. These and other changes or modifications are intended to be included within the scope of the present invention, as expressed in the following claims.

In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

In various embodiments, the embodiments are directed toward one or more computer systems and/or controllers capable of carrying out the functionality described herein. The computer system may include one or more processors. After reading this description, it will become apparent to a person skilled in the relevant art(s) how to implement various embodiments using other computer systems and/or architectures. Computer system can include a display interface that forwards graphics, text, and other data from the communication infrastructure (or from a frame buffer not shown) for display on a display unit.

The computer systems disclosed herein also includes a main memory, such as for example random access memory (RAM), and may also include a secondary memory. The secondary memory may include, for example, a removable storage drive/unit. As will be appreciated, the removable storage unit includes a non-transitory computer usable storage medium having stored therein computer software and/or data.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more."

The invention claimed is:

1. A canted spin dryer comprising:

a vessel comprising a drum having an axis of rotation, wherein the axis of rotation is canted at an angle between about 30 and about 60 degrees from vertical;

a lid coupled to the vessel configured to enclose an interior portion of the vessel;

a locking mechanism configured to restrict movement of the lid in response to being in a locked mode, wherein the canted spin dryer is configured to begin operating in response to a first timer expiring, wherein the first timer is initiated in response to the locking mechanism engaging, wherein the canted dryer is not operating before and during the first timer, and components of the canted spin dryer are configured to be stationary during the first timer;

a lever arm fixedly coupled to the lid at a pivot point; and an overbalanced counterbalance coupled to the lever arm, wherein the counterbalance is configured to automatically pivot the lid about the pivot point to raise the lid away from the interior portion of the vessel from a locked position to an unlocked position via the force of gravity acting on the counterbalance, wherein the unlocked position is an open position.

2. The canted spin dryer of claim 1, wherein a second timer is selected to expire at least one of prior to the drum revolutions per minute reaching zero or in response to the drum revolutions per minute reaching zero.

3. The canted spin dryer of claim 1, wherein the canting angle of the axis of rotation is about 45 degrees from vertical.

4. The canted spin dryer of claim 1, wherein the locking mechanism comprises an electromechanical solenoid.

5. The canted spin dryer of claim 1, wherein the locking mechanism is configured to automatically engage in the locked mode in response to the lid being lowered to a predetermined location.

6. The canted spin dryer of claim 1, wherein the automatic movement of the lid from the locked position to the unlocked position is initiated in response to the locking mechanism disengaging the locked mode.

7. The canted spin dryer of claim 1, wherein a second timer duration initiates in response to the first timer duration expiring.

8. The canted spin dryer of claim 7, wherein the counterbalance is configured to automatically move the lid from the locked position to the unlocked position via the force of gravity acting on the counterbalance in response to the second timer duration expiring.

9. The canted spin dryer of claim 1, wherein the lever arm of the counterbalance is configured to limit the motion of the lid.

10. The canted spin dryer of claim 1, further comprising an indicator, wherein the indicator signals at least one of prior to or in concert with the lid moving from the locked position to the unlocked position.

11. The canted spin dryer of claim 1, wherein the first timer duration is initiated in response to a portion of the locking mechanism engaging in the locked mode in an aperture.

12. The canted spin dryer of claim 1, wherein the first timer is on the order of a few seconds.

* * * * *